US007775480B2

(12) United States Patent
Schulein

(10) Patent No.: US 7,775,480 B2
(45) Date of Patent: Aug. 17, 2010

(54) FLYING OBJECT FOR TRANSONIC OR SUPERSONIC VELOCITIES

(75) Inventor: Erich Schulein, Scheden (DE)

(73) Assignee: Deutsches Zentrum fur Luft-Und Raumfahrt E.V. (DE)

( * ) Notice: Subject to any disclaimer, the term of this patent is extended or adjusted under 35 U.S.C. 154(b) by 188 days.

(21) Appl. No.: 11/698,321

(22) Filed: Jan. 26, 2007

(65) Prior Publication Data

US 2007/0295856 A1 Dec. 27, 2007

(30) Foreign Application Priority Data

Jan. 26, 2006 (DE) ..... 10 2006 003 638

(51) Int. Cl.

| | |
|---|---|
| ***B64C 23/04*** | (2006.01) |
| ***B64C 23/00*** | (2006.01) |
| ***B64C 1/38*** | (2006.01) |
| ***B64C 33/00*** | (2006.01) |
| *F42B 10/46* | (2006.01) |

(52) U.S. Cl. ..... 244/130; 244/1 N; 244/3.1

(58) Field of Classification Search ..... 244/1 N, 244/130, 35 A, 3.21, 3.1, 3.24, 99.1, 38; 102/490, 379, 374

See application file for complete search history.

(56) References Cited

U.S. PATENT DOCUMENTS

| | | | | |
|---|---|---|---|---|
| 2,776,806 A | | 1/1957 | Brendal | |
| 2,932,945 A | * | 4/1960 | Brandt, Jr. | 244/53 B |
| 3,094,072 A | | 6/1963 | Parilla | |
| 3,195,462 A | * | 7/1965 | Petre | 244/3.21 |
| 3,259,065 A | | 7/1966 | Ross et al. | |
| 3,416,758 A | * | 12/1968 | Nicholson et al. | 244/130 |
| 3,713,607 A | | 1/1973 | Hill et al. | |
| 4,351,503 A | * | 9/1982 | Drori | 244/3.24 |
| 4,399,962 A | | 8/1983 | Wedertz et al. | |
| 4,756,492 A | | 7/1988 | Kranz | |
| 4,925,130 A | | 5/1990 | Kranz | |
| 4,998,994 A | * | 3/1991 | Schmidt et al. | 244/3.1 |

(Continued)

FOREIGN PATENT DOCUMENTS

| | | |
|---|---|---|
| DE | 35 03 041 C1 | 9/1986 |

(Continued)

OTHER PUBLICATIONS

Thurman, William, "A Flow Separation Spike for Hypersonic Control of a Hemisphere-Cylinder," AIAA Journal, Jan. 1964, vol. 2, No. 1, pp. 159-161.

(Continued)

*Primary Examiner*—Tien Dinh
*Assistant Examiner*—Richard R Green
(74) *Attorney, Agent, or Firm*—Thomas, Kayden, Horstemeyer & Risley, LLP.

(57) ABSTRACT

The invention relates to a flying object being moved with transonic or supersonic velocities. Known flying objects comprise so called "aerospikes" used for reducing the wave drag and improving the airflow at the front surface of the flying object. The positive effect of these aerospikes is decreased or cancelled in case of the flying object moving in the airflow with an inclination angle between the longitudinal axis of the flying object and the aerospike.

The present invention suggests pivoting the aerospike by means of active or passive measures in order to align the aerospike with the upstream airflow during a flight phase of the flying object.

9 Claims, 16 Drawing Sheets

U.S. PATENT DOCUMENTS

| | | | | |
|---|---|---|---|---|
| 5,048,773 | A * | 9/1991 | Washington et al. | 244/3.28 |
| 5,083,724 | A * | 1/1992 | Kranz | 244/3.21 |
| 5,740,984 | A | 4/1998 | Morgenstern | |
| 6,467,722 | B1 | 10/2002 | Berry et al. | |
| 6,527,221 | B1 | 3/2003 | Kremeyer | |
| 6,581,870 | B1 * | 6/2003 | Runne et al. | 244/1 N |
| 2005/0224630 | A1 | 10/2005 | Henne et al. | |
| 2007/0029438 | A1 * | 2/2007 | Arata | 244/130 |

FOREIGN PATENT DOCUMENTS

| | | | |
|---|---|---|---|
| DE | 36 12 175 | C1 | 10/1987 |
| DE | 38 15 290 | C1 | 8/1989 |
| DE | 199 53 701 | C2 | 1/2002 |
| NL | 88 131 | C | 5/1958 |

OTHER PUBLICATIONS

European Search Report mailed May 21, 2007 in corresponding European Application No. 07001443.6-1260, with English Translation of Category of Cited Documents in European Search Report attached.

Huebner and Mitchell, "Experimental Results on the Feasibility of an Aerospike for Hypersonic Missles," 33rd Aerospace Sciences Meeting and Exhibit, AIAA 95-0737, Jan. 9-13, 1995.

Chang, "Separation of Flow," Pergamon Press, 1966, pp. 468-531.

Bertin, "Hypersonic Aerothermodynamics," AIAA Education Series, 1994, pp. 464-477, 512-517.

Formin, Tretyakov, and Taran, "Flow Control Using Various Plasma and Aerodynamic Approaches (Short Review)," Aerospace Science and Technology, 8, 2004, pp. 411-421.

Kremeyer, "Lines of Pulsed Energy for Supersonic/Hypersonic Drag Reduction; Generation and Implementation," AIAA-2004-0984, AIAA, 2004.

Gnemmi, Srulijes, Roussel and Runne, "Flowfield Around Spiked-Tipped Bodies for High Attack Angles at Mach 4.5," Journal of Spacecraft and Rockets, vol. 40, No. 5, pp. 622-631, Sep.-Oct. 2003.

* cited by examiner

FLYING OBJECT FOR TRANSONIC OR SUPERSONIC VELOCITIES

CROSS REFERENCE TO RELATED APPLICATIONS

This application claims priority to co-pending German Patent Application No. DE 10 2006 003 638.7 entitled "Flugkörper für den Überschallbereich", filed Jan. 26, 2006.

FIELD OF THE INVENTION

The present invention generally relates to a flying object for transonic or supersonic velocities wherein the flying object comprises an aerospike. The aerospike extends from a front surface of the flying object in upstream direction.

BACKGROUND OF THE INVENTION

Providing of a guiding element for the airflow in the shape of a "spike" or so called "aerospike" is known since more than 50 years. Such elements are used for decreasing the pressure and/or the temperature at the front surface of a flying object which moves with supersonic velocities, see Chang, P. K., "Separation of Flow", Pergamon Press, 1970. [1]

Further prior art concerning the general object of reducing the wave drag at blunt flying objects as well as the use of aerospikes might be taken from the following literature:

Bertin J., "Hypersonic Aerothermodynamics", AIAA Education Series, 1994 [2]

Formin V. M., Tretyakov P. K., Taran J.-P. "Flow Control Using Various Plasma And Aerodynamic Approaches (Short Review)", Aerospace Science and Technology, 8, 2004, pages 411-421 [3]

Kremeyer K., "Lines of Pulsed Energy for Supersonic/Hypersonic Drag Reduction; Generation and Implementation", AIAA-2004-0984, AIAA, 2004 (see also: Kremeyer, K., USPTO, U.S. Pat. No. 6,527,221 B1, May 2000 [4]

Gnemmi P., Srulijes J., Roussel K., Runne K., "Flowfield Around Spiked-Tipped Bodies for High Attack Angles at Mach 4.5", Journal of Spacecraft and Rockets, Vol. 40, No. 5, pages 622-631, September-October 2003 [5]

One well known example for the use of an aerospike for a flying object is the missile intended for long distances named TRIDENT. For such missile the aerospike is mounted at a nose that might be semi-spherical or a head of the flying object including a device for seeking a target. The aerospike is aligned with the longitudinal axis of the flying object. During linear flight the aerospike leads to an induced flow separation at the distal end region of the aerospike. Such phenomenon is a result of an interaction of a bow shock wave with the boundary layer of the aerospike. The induced flow separation leads to a significant decrease of the wave drag which according to [1] sums up to 80%.

German Patent No. DE 199 53 701 C2, corresponding to U.S. Pat. No. 6,581,870, includes the observation that during flight conditions with the upstream airflow not exactly aligned with the longitudinal axis of the flying object the separated flow at the distal end of the aerospike is moved to a "lee side" whereas the upwind region of the front surface of the flying object is hit by the airflow. For such flight conditions despite the use of the aerospike, undesired increases of the temperature as well as the pressure may be observed. DE 199 53 701 C2 suggests using an aerospike with a spherical, ellipsoidal or drop-shaped extension instead of an aerospike with a constant cross-section with a tip or a plate-like element at its distal end. Such design leads to a shock wave at the distal end region of the aerospike which is immediately damped by an expansion fan. Downstream of the expansion a flow separation occurs at the lee side of the extension. The separated flow merges with the following separation bubble at the front of the hemispherical nose of the flying object. Accordingly, that leads to the reduction of the pressure at the entire front surface of the flying object resulting in a decrease of the wave drag as well as of the heat loads. Accordingly, an extension which might be spherical should lead to the airflow in the region of the front surface of the flying object being to the greatest possible extent independent on the angle between the airflow upstream the flying object and the longitudinal axis of the flying object.

U.S. Pat. No. 3,713,607 discloses an aerospike for a flying object moving with supersonic velocity wherein the aerospike comprises the shape of a hollow cylinder and the girthed area of the cylinder is perforated. The fixation of the aerospike at the front surface of the flying object is designed such that during manufacturing, mounting and prior to the start of the flying object it is possible to adjust the angle between the longitudinal axis of the aerospike and the longitudinal axis of the flying object according to expected flight conditions.

Further prior art is known from AIAA 95-0730, DE 36 12 175 C1, corresponding to U.S. Pat. No. 4,756,492, and U.S. Pat. No. 6,527,221 B1.

OBJECT OF THE INVENTION

One object of the invention is to provide a flying object with an aerospike leading to decreased negative effects of the airflow upstream the flying object in cases where the streaming direction of the upstream airflow is inclined with respect to the longitudinal axis of the flying object.

SUMMARY OF THE INVENTION

One feature of the invention addresses the common thinking that an adaptation of a flying object comprising an aerospike to future flight conditions should be done by means of a-priori-measures or prior to the start of the flying object. Instead according to the invention the aerospike might be pivoted under consideration of the actual flight and flow conditions of the flying object. In cases where changes of the angle of the upstream airflow are only expected or relevant in a plane including the longitudinal axis of the flying object it might be sufficient providing a pivoting axis which is directed perpendicular to the longitudinal axis and to the aforementioned plane. However, it is also possible that the link between the aerospike and the flying object is designed and arranged for providing a three-dimensional degree of freedom of the aerospike linked at one point at a fixed or movable front surface of the flying object. Such one-dimensional, two-dimensional or three-dimensional degree of freedom might be used for aligning the aerospike with the upstream airflow or for adjusting the angle of the aerospike between the angle of the upstream airflow and the longitudinal axis of the flying object (in the following "inclination angle", in the literature also denoted with "angle of incidence" or "angle of attack"). Such embodiment provides the possibility to eliminate or decrease the influence of the inclination angle on the air stream in the region of the front surface or nose of the flying object.

According to the invention an "aerospike" in particular relates to an element guiding the airflow which by means of a local air stream being induced upstream a front surface or nose of the flying object increases the effective slenderness of the flying object and reduces the wave drag. In particular the creation of such local air stream at the nose of the flying object might be provided by means of so called "jet spikes", often called "counterflow-jet", cp. [3], or might be directly provided by manipulation of the overall pressure distribution in the atmosphere leading to an interaction of the shockwave at the nose of the flying object for building a re-circulating air stream. For another embodiment also devices with an optical, electrical or electromagnetic heating of the air stream might be amended to rod-like aerospikes or by building so-called "beam-spikes". The aforementioned design and method is also called "energy deposition control", cp. [3], [4].

According to another embodiment of the invention the aerospike is pivoted by means of passive measures. Passive measures according to the invention in particular denote any cause of the pivoting movement without using an internal energy source of the missile. As one possible energy source used for the passive measures the airflow might serve. In an alternative or cumulative embodiment of the invention the passive measures are measures without any use of logic elements, e.g. without use of a control device. Accordingly, such pivoting movement caused by passive measures does not require additional energy and/or demands for a control. Such requirements and demands might lead to further problems in particular for flying objects used for long distances, flying objects being stored for longer time periods and/or flying objects wherein the overall weight is critical.

Furthermore, by using passive measures the adaptation of the orientation of the aerospike might be provided with a simple construction which is less prone to error also under rough conditions.

According to another embodiment of the invention, at least one justifying element, adjusting element or aligning element (in the following abbreviated as "justifying element") is provided. The autonomous and passive pivoting of the aerospike is activated by the airflow directed against and impinging on the justifying element. The justifying element might be built by a rigid element following the principle of a vane and might be located downstream of the pivoting point or axis of the aerospike wherein an alignment of the justifying element with the air stream coincides with an alignment of the aerospike. The justifying element might be comprise a curved or flat plane that interacts with the airflow.

According to an alternative embodiment the justifying element might be built with a grid fin or a lattice wing. Such embodiment comprising a vain with a grid fin leads to an excellent stability of the aligned position of the aerospike.

Besides the aforementioned passive pivoting of the aerospike, the pivoting might be caused by active measures or actuators. The feature "active" is used for causing pivoting of the aerospike under use of an energy supply of the flying object and/or use of a control unit interacting with a suitable actuator. Such an active pivoting might consider predicted or desired flight conditions and air stream conditions and/or actual or measured flight conditions or air stream conditions.

According to another embodiment of the invention, the flying object comprises a measurement element or sensor for sensing the flight conditions. Such sensor might sense or approximate the actual existing inclination angle between the longitudinal axis of the flying object and the upstream airflow. Under consideration of the measurement signal of the sensor the aerospike might be pivoted in an active manner wherein by use of such embodiment the actual flight conditions, the environment and the air stream might be taken into account under high precision.

Possible sensors are in particular sensors based on a flag-like element wherein a signal is produced which is dependent on the angular position of the flag which might be built by a rigid body, a measuring element for sensing a pressure or stresses or loads of any constructional element of the flying object wherein the pressure or the stress or load measured at the element is dependent on the angle of inclination.

It is also possible that the flying object comprises a storage unit. In the storage unit a fixed sequence of a desired manipulation of the angle of the aerospike during the flight phase might be stored. During the flight phase of the flying object the aerospike might be actively pivoted under consideration of the stored sequence. In the simplest case different flying phases as climbing, flight with constant altitude and/or linear flight and an arrival phase or descending phase might be stored with the expected times for these phases and estimated optimized angles. By means of a change of the orientation of the aerospike, the different flight phases might be considered. Also different other flight phases might be considered a priori in the storage unit.

In case of the different necessary inclination angles being caused by steering actions of the flying object a very simple possibility for determining a suitable pivoting angle of the aerospike is given by coupling the steering action of the flying object with the pivoting angle and the pivoting of the aerospike.

According to one embodiment in a storage unit and a control unit an optimal pivoting angle of the aerospike is stored in dependence on the steering action of the flying object. During the flight phase from any demand of a suitable steering action an optimal pivoting movement of the aerospike might be determined. Such dependence between a steering action and the pivoting angle of the aerospike might be stored in mathematical form as a dependency from one or a plurality of variables or in the form of a characteristic diagram. In the simplest form the pivoting of the aerospike is coupled with a steering element of the flying object by means of electrics, mechanics and/or hydraulics.

According to another embodiment of the invention, the aerospike is pivoted as one unit with the front surface of the flying object. By use of such embodiment the front surface might be designed free of any grooves, guiding elements, bearings and the like used for providing the pivoting degree of freedom. Such grooves, guiding elements or bearings have a large impact on the airflow conditions due to the fact that these irregularities are located at the front surface. Instead, according to the invention there is an extension of the design possibilities for designing and shaping the transitional region between the front surface and the aerospike. In case that the front surface in the region of the aerospike does not comprise a partially spherical shape the pivoting movement of the aerospike as one single unit with the front surface might be used for providing a dependency of the orientation of the front surface with respect to the upstream airflow.

The front surface might also be built with a pivotable dome-shaped head housing a device for seeking and following a target. Such device might seek a target by means of an IR-transmission or the transition of radar waves. The need of the use of a dome with a head for seeking a target might be more important than optimizing the aerodynamics. Such flying object might be equipped with a semi-spherical nose. The nose in general leads to a large wave drag. However, the functionality of the device for seeking a target might be increased which is often of advantage in particular for highly agile flying objects. Inside a dome the necessary radar antenna or IR-sensors might be located at optimal positions. The whole "view area" of the dome might be built by a material transparent for the infrared or radar waves used for seeking the target. Such concept including means for causing a corresponding separate movement of the head provides seeking and following a target independent on the flight direction. Due to the requirement that the dome has to be manufactured from a transparent material it might be necessary that a material is used which is suitable for increased demands with respect to the maximal temperatures and pressures at the dome.

According to another embodiment the design features (and the resulting advantages) disclosed in DE 199 53 701 C2 might be integrated into the aforementioned flying object. For such design the pivotable aerospike comprises an extension at its distal end region. Such extension might be built by a sheet, a sphere, a cone, a drop-like shape or an ellipsoid.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
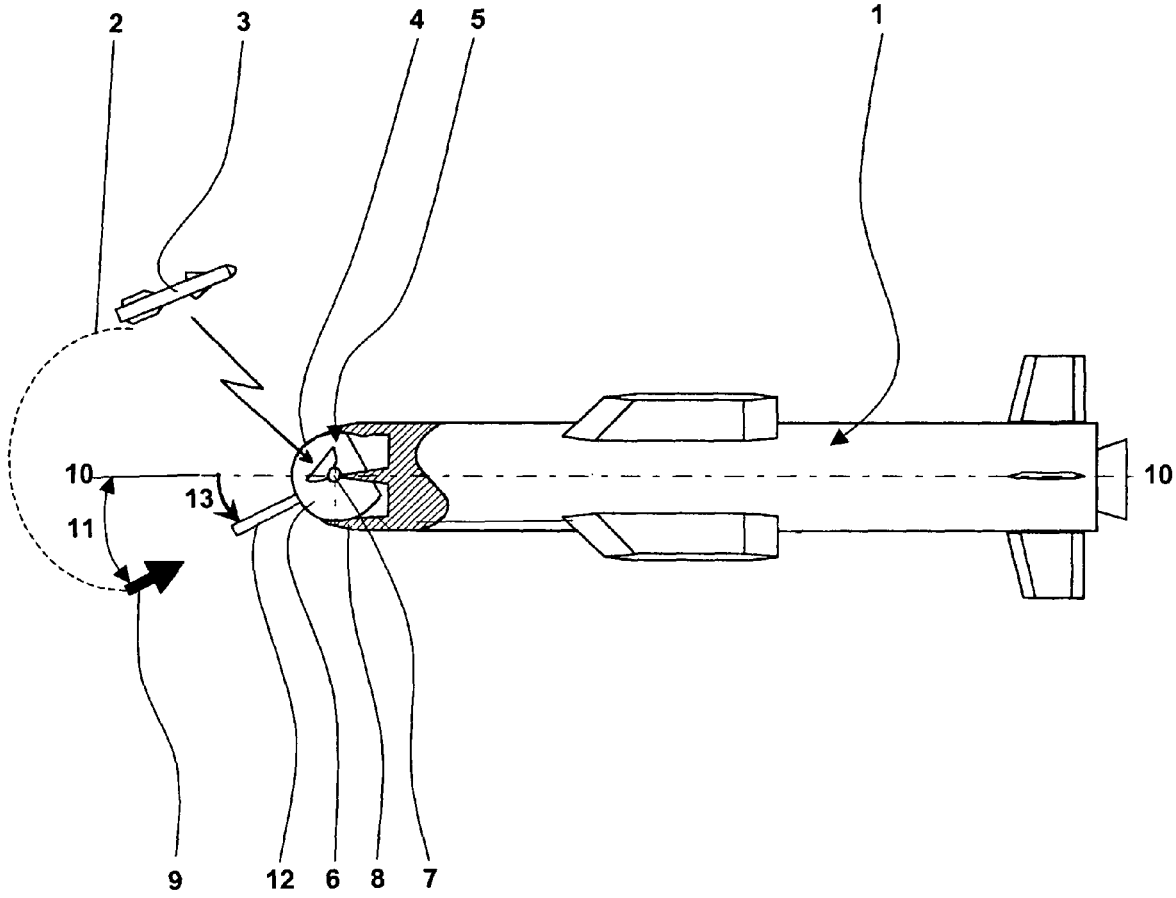
FIG. 1 is a side view of a flying object comprising a pivotable dome housing a head for seeking a target wherein the aerospike builds a pivotable unit with the dome.

Referring now in greater detail to the drawings, FIG. 1 illustrates a flying object 1. In particular such flying object is a rocket, a missile, a drone, a projectile or a flying object which is driven by itself at least during a part of the trajectory, e.g. by means of a jet engine, wherein such flying object might carry at least one of the necessary fuel and/or a substance used for oxidation. After its start the flying object might be steered or unsteered. Furthermore, the flying object might move through the air or at least partially in water. The flying object moves at least partially with supersonic or transonic velocities. Furthermore, the flying object might be an aircraft or warplane or a component of the same wherein the aircraft or warplane or the component

- in a first approximation comprises a cylindrical shape,
- comprises a blunt nose or front surface,
- moves at least partially with transonic or supersonic velocities and
- is fitted with an aerospike.

Exemplifying embodiments of such components are outer tanks, ammunition located at the outer circumference of the vehicle, pylons, antenna at the wings and the like.

The flying object 1 shown in the figures is used for searching, following or engaging an unmovable or movable target on land, in water or in the air wherein the flying object moves over a trajectory between a starting point and the target. In the embodiment shown in FIG. 1 the target is an adversarial missile 3. The flying object at its front surface 4 comprises a head 5 for seeking a target. The head 5 is used for locating the target relative to the flying object and for influencing the justifying elements under use of the control unit such that the trajectory 2 of the flying object 1 ends at the target. The front surface 4 is built with an approximately partially spherical dome 6 housing the head for seeking the target. The dome 6 is pivotable with respect to a pivoting axis wherein a universal joint, ball joint or ball and socket joint might be used. It is also possible that the dome comprises a two- or three-dimensional degree of freedom under use of a universal joint linking the dome with the flying object 1. The dome 6 comprises a sealed and smoothed aerodynamic transition to the tube-like girthed area 8 of the flying object 1 irrespective of the pivoting of the aerospike. In FIG. 1 an arrow indicates the airflow of the medium wherein the flying object 1 is moved. The upstream airflow and a longitudinal axis 10-10 build an inclination angle 11. In the flight phase shown in FIG. 1 the inclination angle 11 might (temporarily) differ from zero.

In a neutral position correlating with an inclination angle equal zero, wherein the airflow 9 is aligned with the longitudinal axis 10-10, the aerospike mounted with the dome 6 is aligned with the longitudinal axis 10-10 and the airflow. In the shown embodiment, the aerospike 12 is a spike with a cylindrical outer shape or girthed area. The length of the aerospike is a multiple of its diameter. At the proximal end region, the aerospike 12 is fixed at the dome 6 housing the head for seeking a target. In the shown embodiment, the distal end region is tapered or comprises a cone-shaped tip. For alternative embodiments the geometries and extensions shown in DE 199 53 701 C2 might also be used.

For an adaptation of the flying object to inclination angles 11 differing from zero according to FIG. 1, the dome 6 is pivoted with respect to an axis oriented vertical to the drawing plane resulting in a pivoting angle 13 of the aerospike 12 with respect to the longitudinal axis 10-10. For the embodiment shown in FIG. 1, the pivoting angle 13 equals the inclination angle 11 wherein for different constructions, dimensions and designs it might also be possible that the pivoting angle 13 differs from the inclination angle 11. In particular, the pivoting angle 13 is chosen or controlled to be smaller than the inclination angle 11. Due to the fact that the dome 6 is linked with the remaining part of the flying object by a bearing located inside the dome the fixation point of the aerospike 12 at the dome 6 during pivoting moves on a circular path with the pivoting axis 7 located at the center of the circular path. The radius of the circular path is the distance between the fixation point and the pivoting axis. An increase of the pivoting angle increases the distance of the fixation point from the longitudinal axis 10-10.

Figure 2:
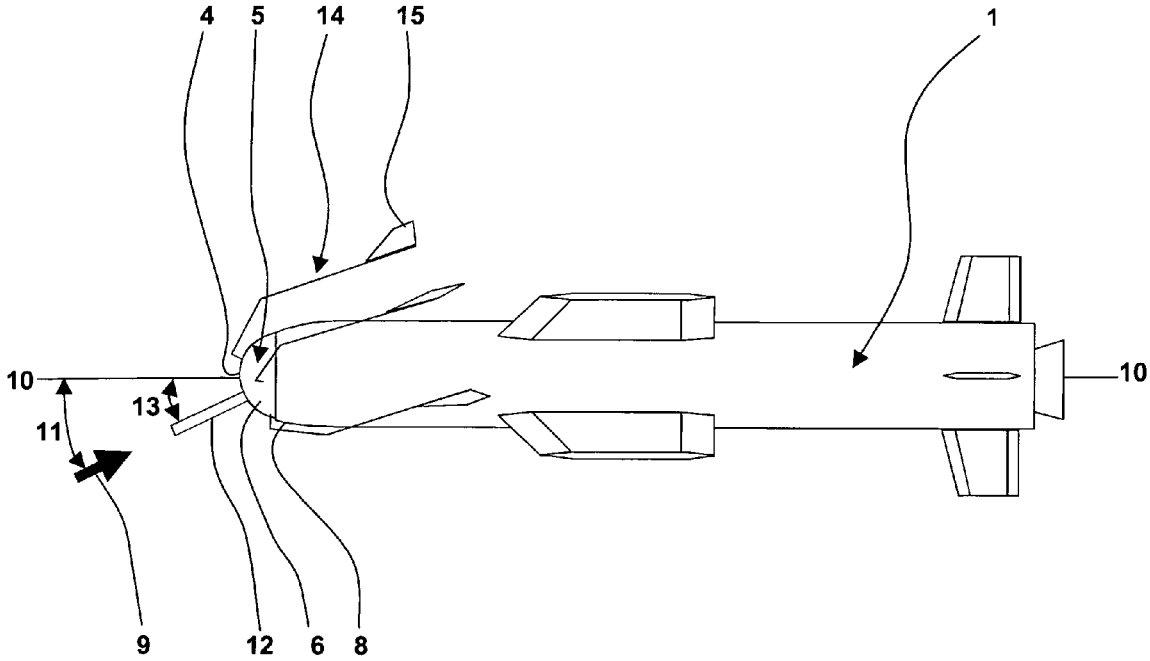
FIG. 2 is a side view of an alternative embodiment of a flying object wherein pivoting of the aerospike is caused by passive justifying elements.
Figure 16:
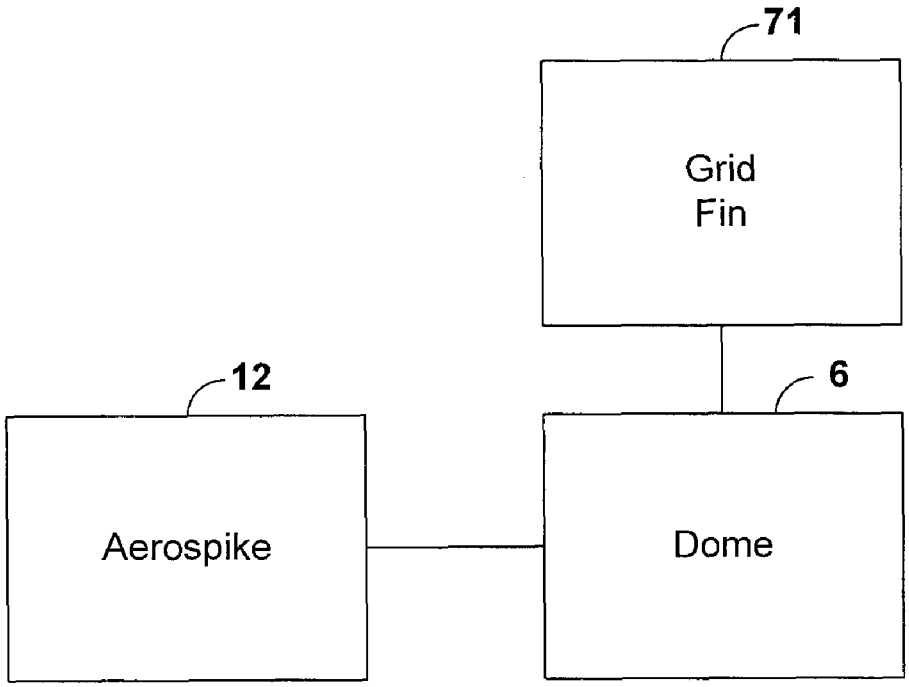
FIG. 16 is a block diagram illustrating a dome carrying a grid fin.
Figure 17:
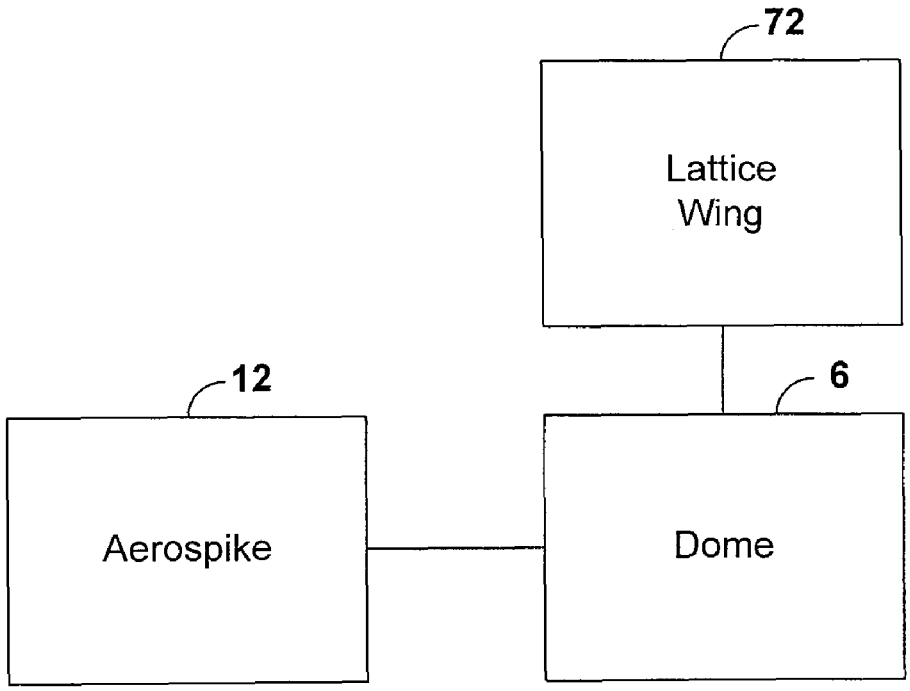
FIG. 17 is a block diagram illustrating a dome carrying a lattice wing.

FIG. 2 shows an embodiment for providing a pivoting movement of the aerospike 12 under use of passive measures. According to such embodiment of the invention the dome 6 housing a device for seeking a target carries justifying elements 14. In a first approximation the justifying elements 14 are L-shaped wherein the free end region of the shorter leg of the L is rigidly fixed at the dome 6 and the longer leg of the L in the neutral position is aligned parallel to the longitudinal axis 10-10 and comprises a small distance from the girthed area 8 of the flying object 1. The end region of the justifying elements 14 opposing the dome 6 comprises a surface 15 or tail or a lattice wing 72 (FIG. 17) or a grid fin 71 (FIG. 16). The surface 15 or the grid fin is located downstream the pivoting axis 7 so that forces induced by the airflow acting upon the surface 15 lead to an exact alignment of the aerospike 12 with the airflow 9. This is due to the fact that forces acting on the surfaces 15 are larger than forces of the airflow acting upon the aerospike 12. The distance of the justifying elements 14 from the girthed area 8 of the flying object 1 is chosen such that the necessary pivoting with a predetermined maximum pivoting angle 13 is possible during an expected flight phase.

Figure 3:
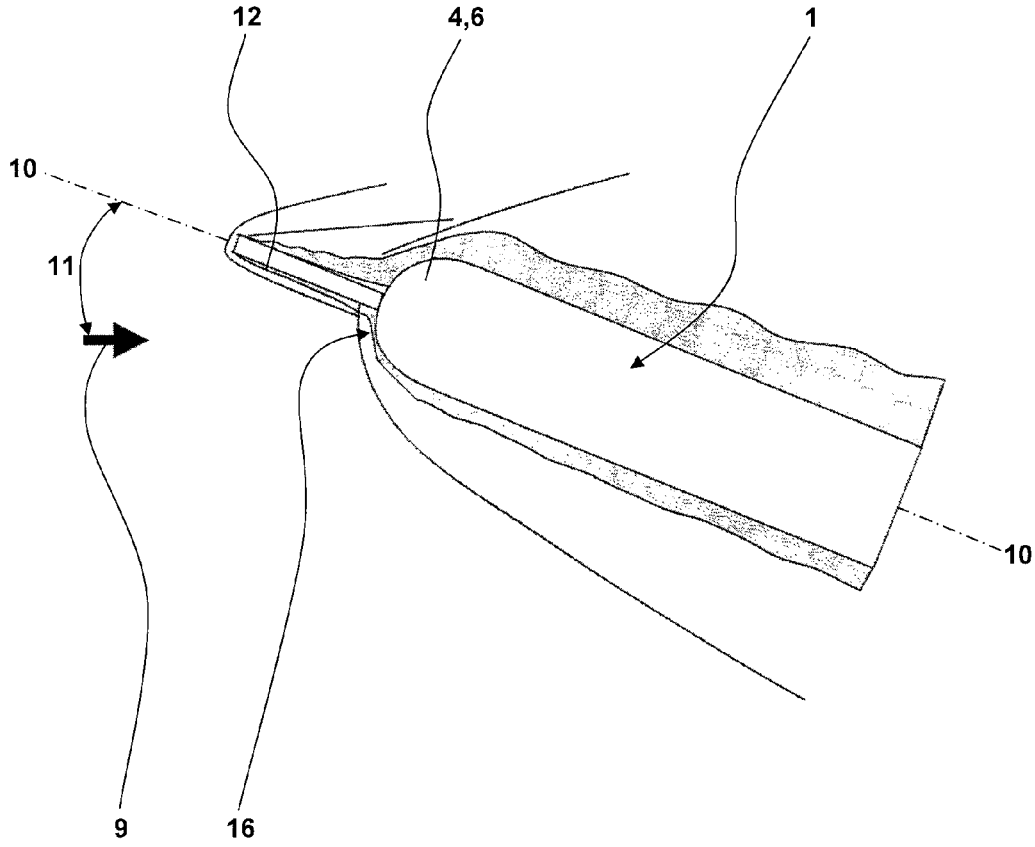
Fig. 3 (Prior Art)
FIG. 3 shows the airflow for an inclination angle differing from zero for an aerospike according to the prior art which is not pivotable.
Figure 4:
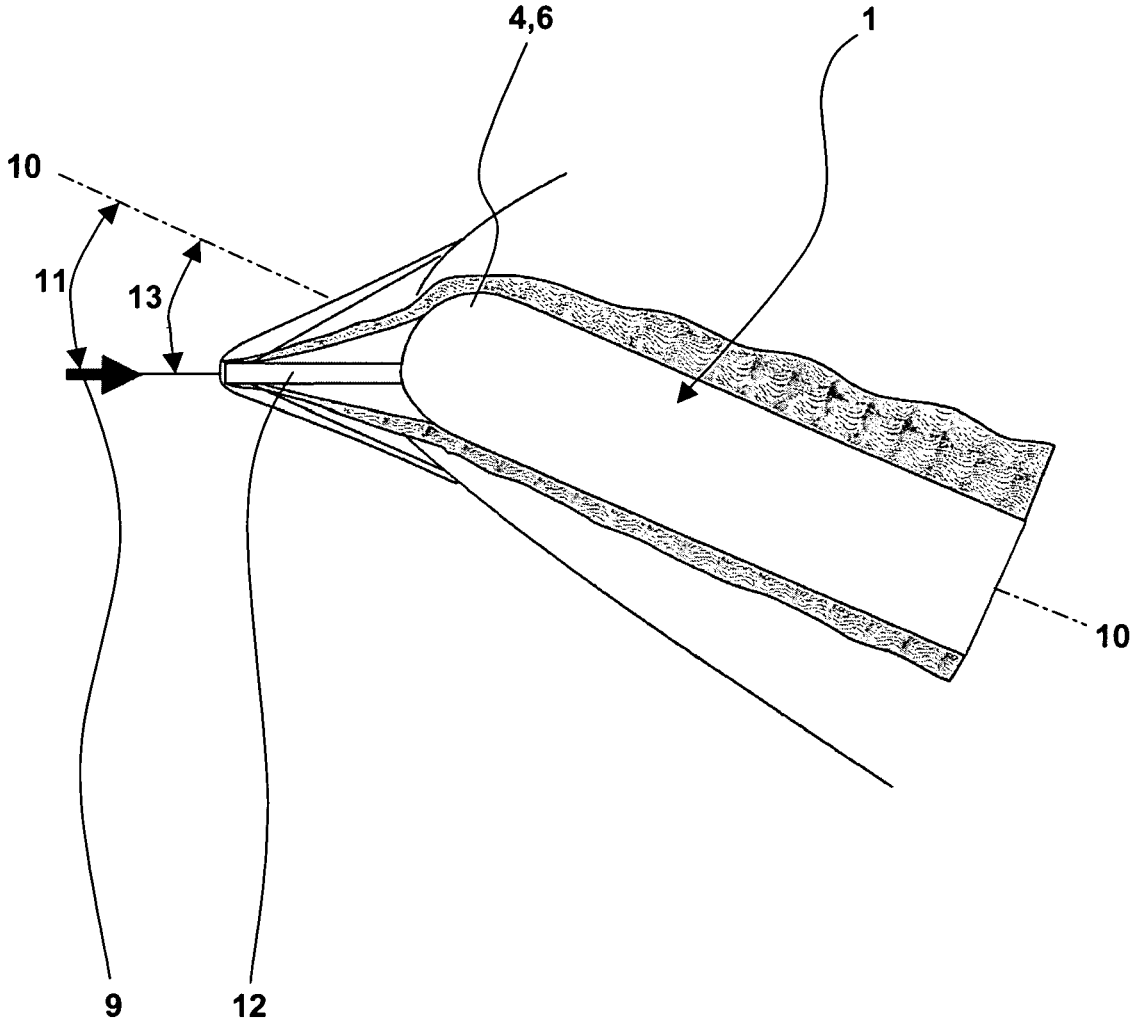
FIG. 4 shows the airflow for an inclination angle differing from zero wherein according to the invention the aerospike is pivoted to a pivoting angle.

FIGS. 3 and 4 show a sketch of the resulting airflow for an inclination angle differing from zero wherein FIG. 3 shows a fixed aerospike 12 according to the prior art and FIG. 4 shows a pivotable aerospike according to the present invention. According to FIG. 3, the front surface 4 and the dome 6 are hit or impinged by the air stream unobstructed in region 16. Instead according to FIG. 4 for the same flight conditions such impinging is generally avoided by pivoting the aerospike 12.

Figure 5:
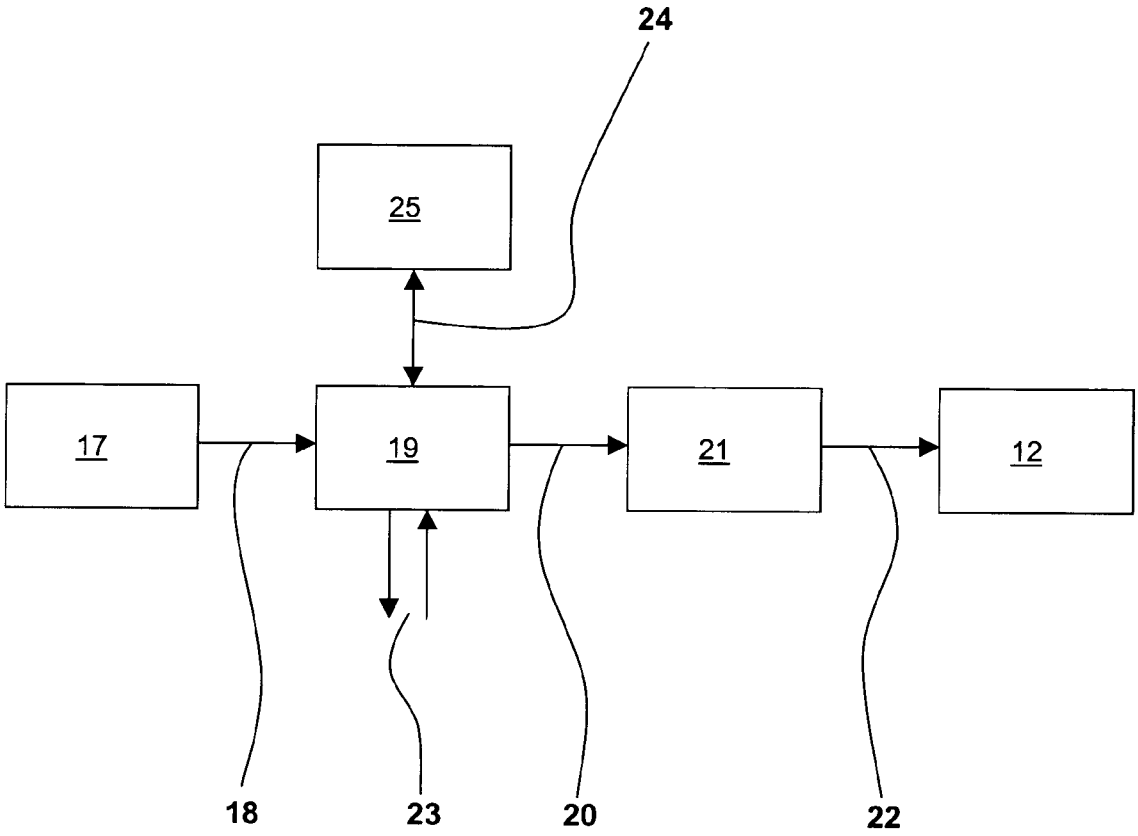
FIG. 5 shows a schematic block diagram for a control unit used for an active pivoting of an aerospike of a flying object.

FIG. 5 shows a schematic block diagram for actively controlling the pivoting angle 13 of the aerospike 12 with respect to the longitudinal axis 10-10 of the flying object. A sensor 17 provides a signal 18 at least correlating with the inclination angle 11. Signal 18 is fed to a control unit 19. Control unit 19 determines an appropriate activation signal 20 for an actuator 21. The actuator 21 acts upon the aerospike 12 for changing the pivoting angle 13. Such interaction caused by the actuator 21 might be a force, a moment, a distance or an angle 22. The control unit 19 might be used only for controlling the inclination angle. According to an alternative embodiment indicated in FIG. 5 the control unit 19 might be used for additional functions, e.g. producing steering signals 23 for influencing the trajectory 2 of the flying body 1 or for processing signals of head 5 for seeking a target. The control unit 19 communicates via signal line 24 with a storage unit 25. For one embodiment, the storage unit 25 is used for storing signals or sequences of the pivoting angle 13 for the aerospike 12 determined a priori. In a cumulative or alternative embodiment, dependencies of the activation signal 20 on signal 18 and/or steering signals 23 might be stored, e.g. by means of functional parameters or characteristic diagrams.

Possible shapes of aerospikes 12 include
blunt or spiky aerospikes,
aerospikes with discs, spheres or cones or
any such combinations located at the nose
as well as aerospikes using a plasma, fluid or gas stream produced or entering in upstream direction.

Any such embodiment might be used in combination with a pivotable dome comprising a head for seeking a target as well as in combination with a separate movable structure or slide.

Figure 6A:
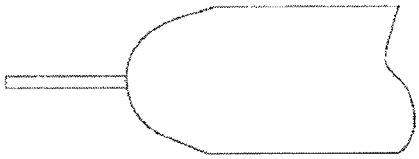
FIGS. 6*a-h* show different embodiments of geometries used for an aerospike.
Figure 6B:
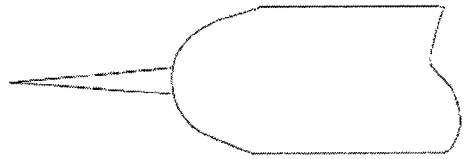
Figure 6C:
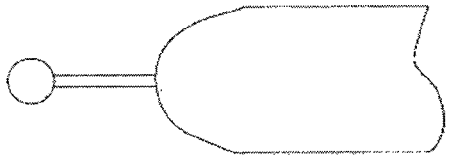
Figure 6D:
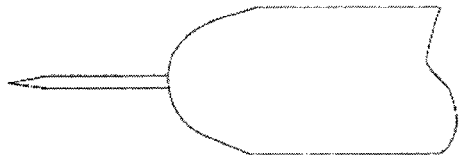
Figure 6E:
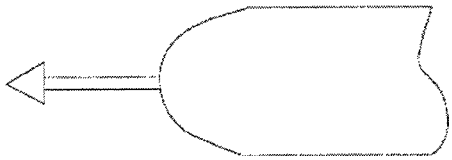
Figure 6F:
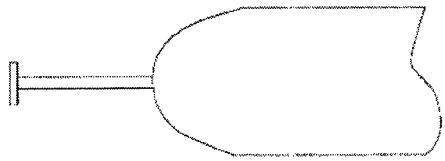
Figure 6G:
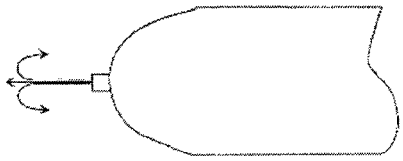
Figure 6H:
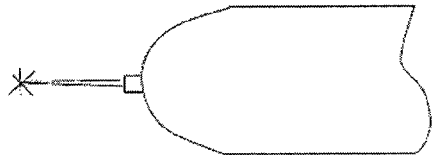

FIGS. 6*a-h* show examples for different embodiments of basic configurations of an aerospike located at the nose of a flying object:

FIG. 6*a* shows an aerospike with a constant cross-section, e.g. a cylindrical aerospike, FIG. 6*b* shows an aerospike with a triangular longitudinal cross-section or a conical shape, FIG. 6*c* shows an aerospike with a spherical extension located at its distal end region, FIG. 6*d* shows an aerospike with a spiky or conical end region and a central region comprising a constant cross-section, FIG. 6*e* shows an aerospike comprising an extension at the distal end region which in longitudinal section is approximately triangular wherein the tip of the triangular extension points in upstream direction, FIG. 6*f* shows an aerospike with an extension in the form of a disc located in the distal end region, FIG. 6*g* shows an aerospike with a "jet-spike" wherein in FIG. 6 arrows indicate a gas or fluid stream exiting the aerospike at the distal end region and directed in upstream direction and FIG. 6*h* shows an aerospike with a "beam-spike" wherein the beam-spike locally heats the air by means of optical, electrical or electromagnetical heating.

Figure 7:
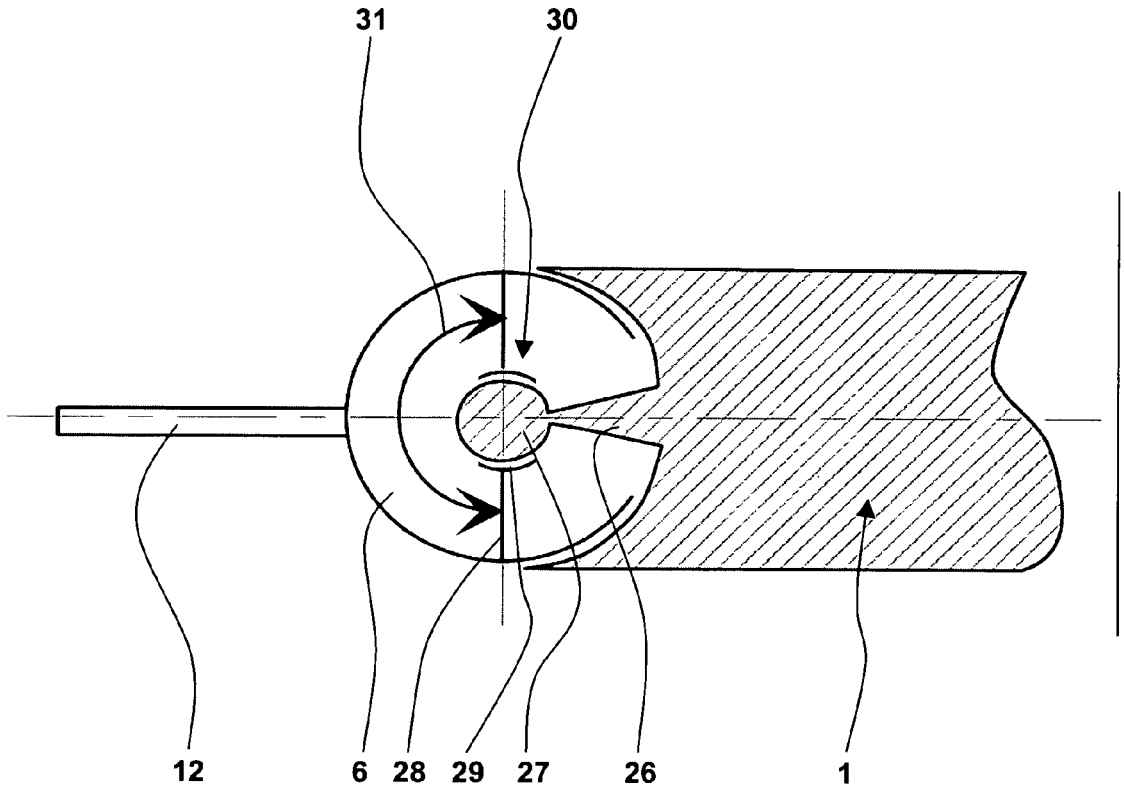
FIG. 7 in a longitudinal sectional view shows another embodiment of bearing with a pivoting degree of freedom for a dome housing a head for seeking a target wherein the aerospike is fixed at the dome.

For the embodiment shown in FIG. 7, the flying object 1 comprises an extension 26 in the front end region wherein the extension 26 is mounted with a spherical end region 27. Rigidly connected with the dome 6 is a beam or arm 28 extending in inner direction and carrying a sleeve 29 for the spherical end region 27. The spherical end region 27 and the sleeve 29 build a link 30. The link 30 provides a two- or three-dimensional degree of freedom for pivoting the dome 6 with the aerospike 12 fixed at the dome, e.g. for pivoting the aerospike 12 in direction 31 with respect to the remaining part of the flying object 1.

Figure 8:
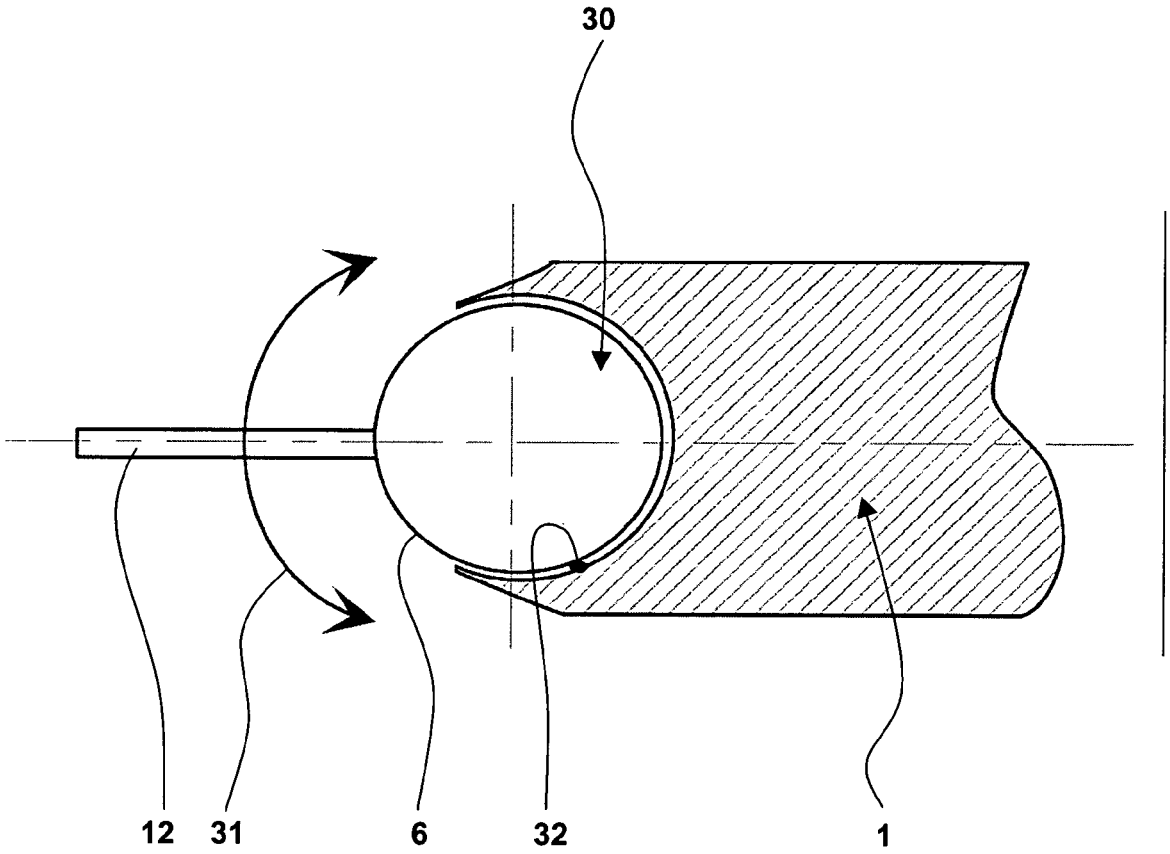
FIG. 8 in a longitudinal sectional view shows another embodiment of a pivotable bearing of a dome housing a head for seeking a target with an aerospike fixed at the dome.

According to the embodiment shown in FIG. 8, the dome 6 comprises an approximately spherical outer shape. The dome 6 is housed in a housing 32 of the flying object 1 under formation of a link 30. In case that for such embodiment a head for seeking a target has to be integrated into the dome 6, such head might be constructed as a separate unit. According to an alternative embodiment a transfer of electrical signals between the body of the flying object 1 and the dome 6 housing the head for seeking the target might be provided.

Such transfer might be accomplished by using sliding contacts, movable or bendable wires or a contactless transfer or transfer by radio signals.

Figure 9:
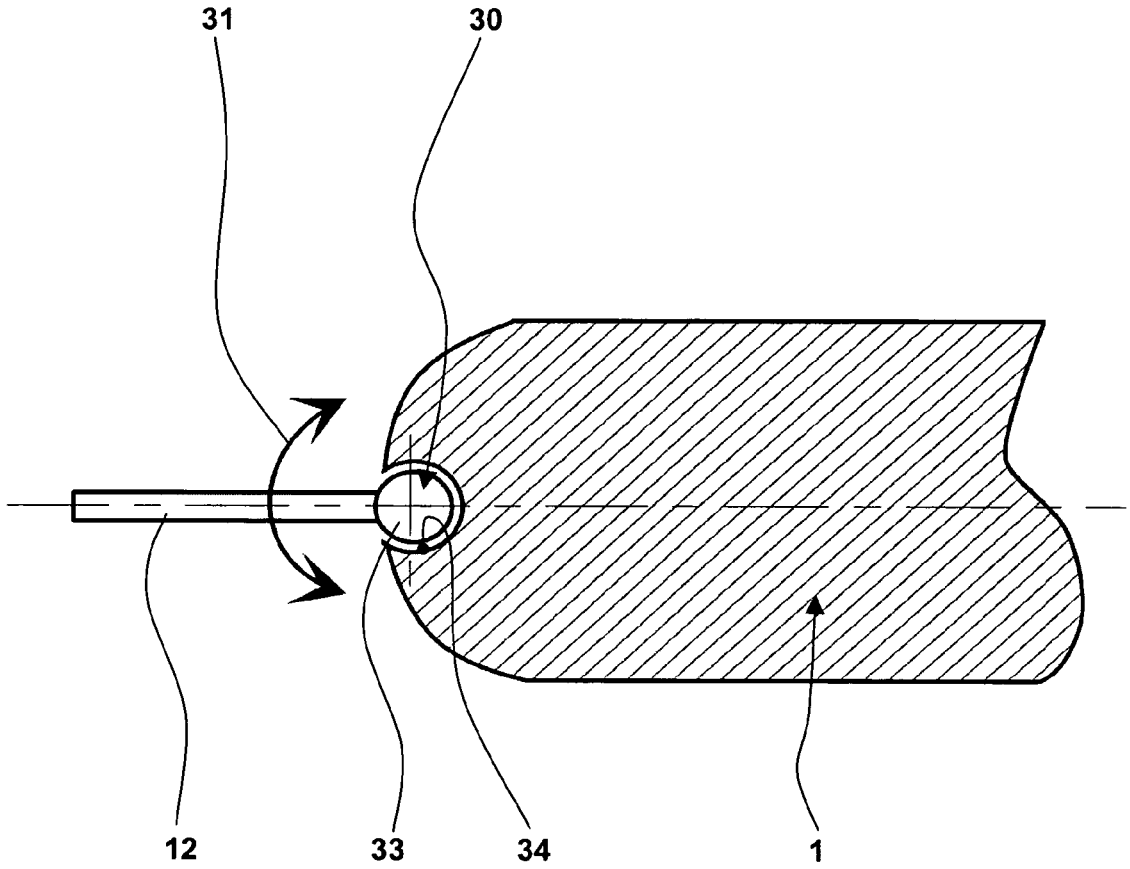
FIG. 9 in a longitudinal sectional view shows another embodiment of a pivotable link of an aerospike with a front surface of a flying object.

For the embodiment shown in FIG. 9, the aerospike comprises a spherical or cylindrical end region 33. The end region 33 runs in a bearing built in a cylindrical or spherical housing 34 for providing a pivotable degree of freedom in the drawing plane or for providing a two- or three-dimensional degree of freedom. The interaction between the end region 33 and the housing 34 builds the link 30.

Figure 10:
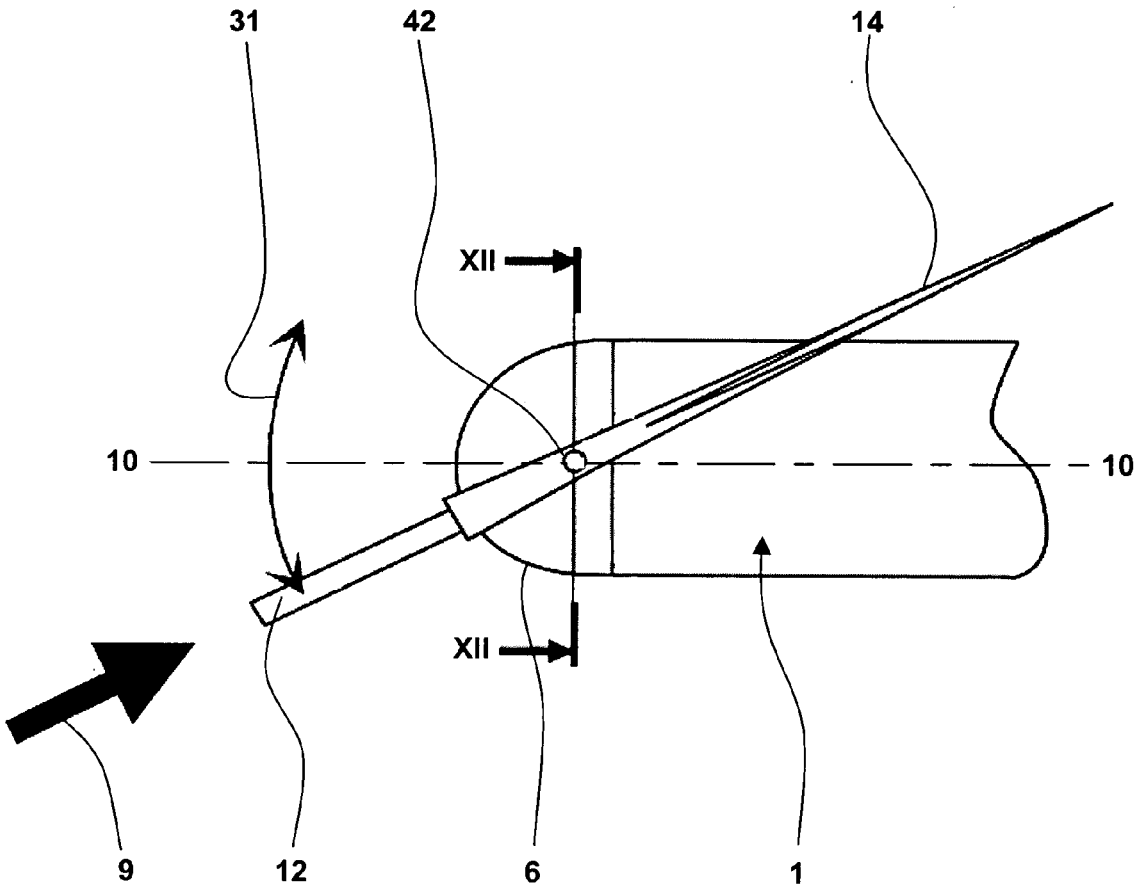
FIG. 10 shows a flying object according to the invention in a lateral view wherein pivoting of the aerospike with respect to an axis fixed with respect to the flying object is caused by passive justifying elements.
Figure 11:
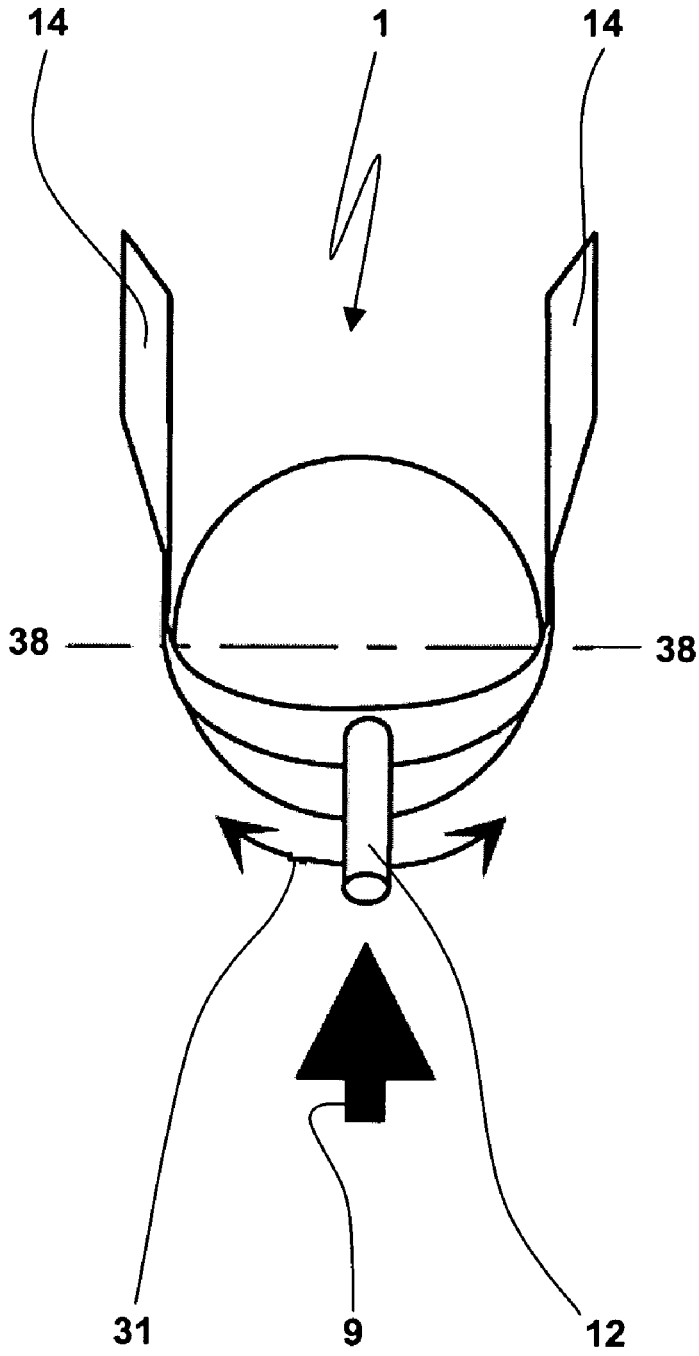
FIG. 11 shows the flying object according to FIG. 10 in a front view.
Figure 12:
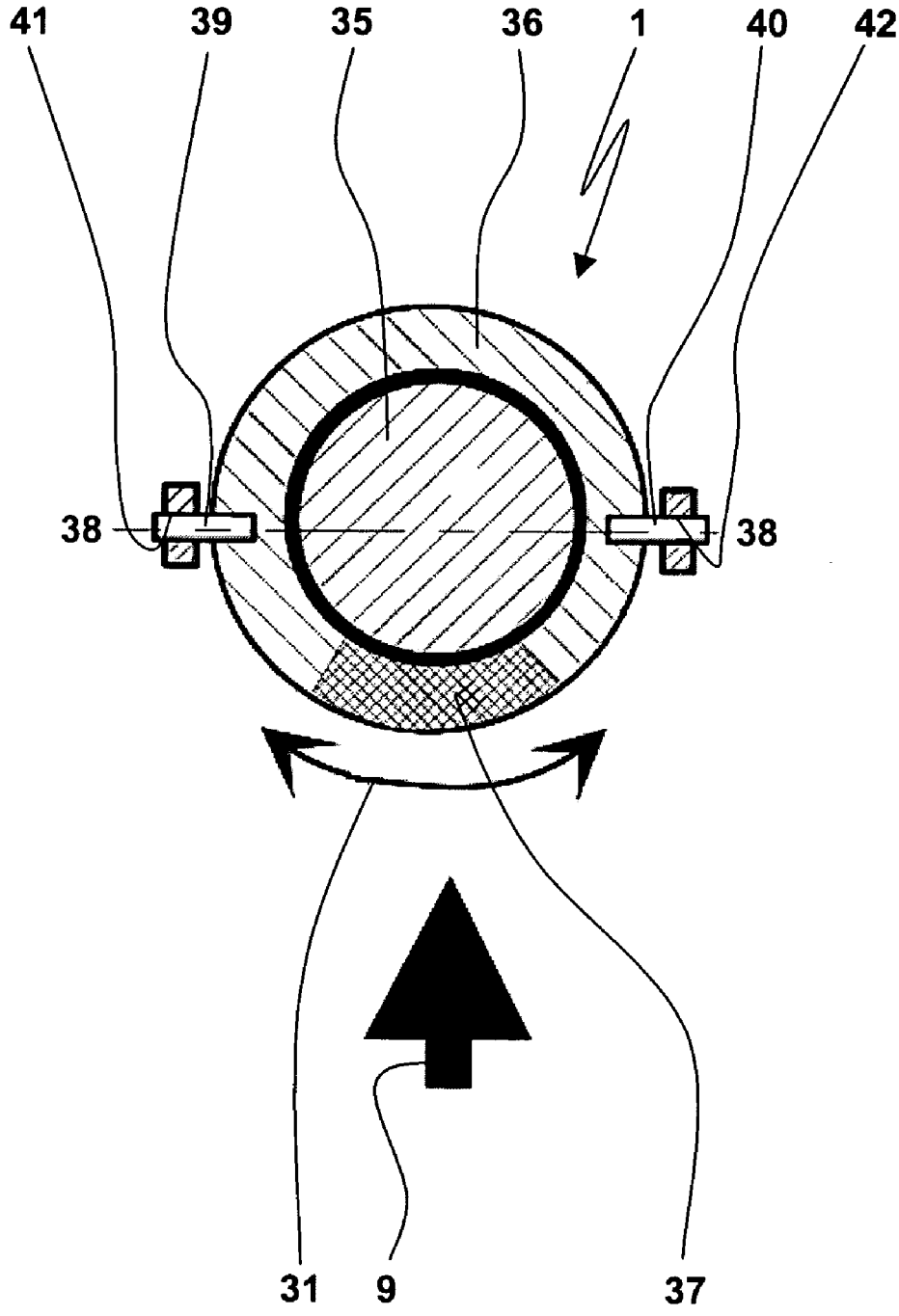
FIG. 12 shows the flying object according to FIGS. 10 and 11 in a cross-sectional view XII-XII.

FIGS. 10 to 12 show another embodiment of the invention using a passive alignment or justification of the aerospikes 12. A cylindrical extension 35 of the front surface builds a sliding support for a hollow cylindrical sleeve 36 for pivoting the sleeve 36 with respect to the longitudinal axis 10-10 of the flying object 1. The center of gravity of the sleeve 36 might be eccentrically with respect to the longitudinal axis 10-10, e.g. due to a region 37 made of a material with a large density. The embodiment with an eccentric location of the center of gravity of sleeve 36 (with additional components) has the following effects:

Gravity causes a moment acting upon sleeve 36 forcing the center of gravity of sleeve 36 (and their affixed additional components) to be located exactly below the longitudinal axis. Such design leads to the result that during linear flight without any lateral accelerations a transverse axis 38-38 comprises an orientation transverse to the vertical axis. Independent on any rolling of the flying object 1 with respect to the longitudinal axis 10-10, sleeve 36 comprises a constant orientation with respect to the field of gravity.

In case of any transverse accelerations acting upon the flying object 1, e.g. caused by a steering movement, location of the center of gravity of sleeve 36 (with additional affixed components) below the longitudinal axis causes an adjusting moment which tends to rotate sleeve 36. Such adjusting moment might be used for automatically aligning the transverse axis 38-38 according to a lateral acceleration, a steering interaction and/or a change of the inclination angle.

Sleeve 36 carries bearing pins 39, 40 on both sides. The bearing pins are aligned with the transverse axis 38-38. Aerospike 12 with the justifying elements 14 comprises bearing eyes 41, 42 for providing a pivoting degree of freedom with respect to the transverse axis 38. For the embodiment shown in FIGS. 10 to 12 the justifying elements 14 have a plate-like design. The material of the justifying elements 14 extends in circumferential direction of dome 6 having a circular cross-section. At a centered position of the circumference the justifying elements 14 are rigidly fixed at the aerospike 12. The plates are curved or inclined in the end region which opposes the aerospike 12. Due to such design the surfaces interact with the airflow and produce forces for pivoting the aerospike 12.

Figure 13:
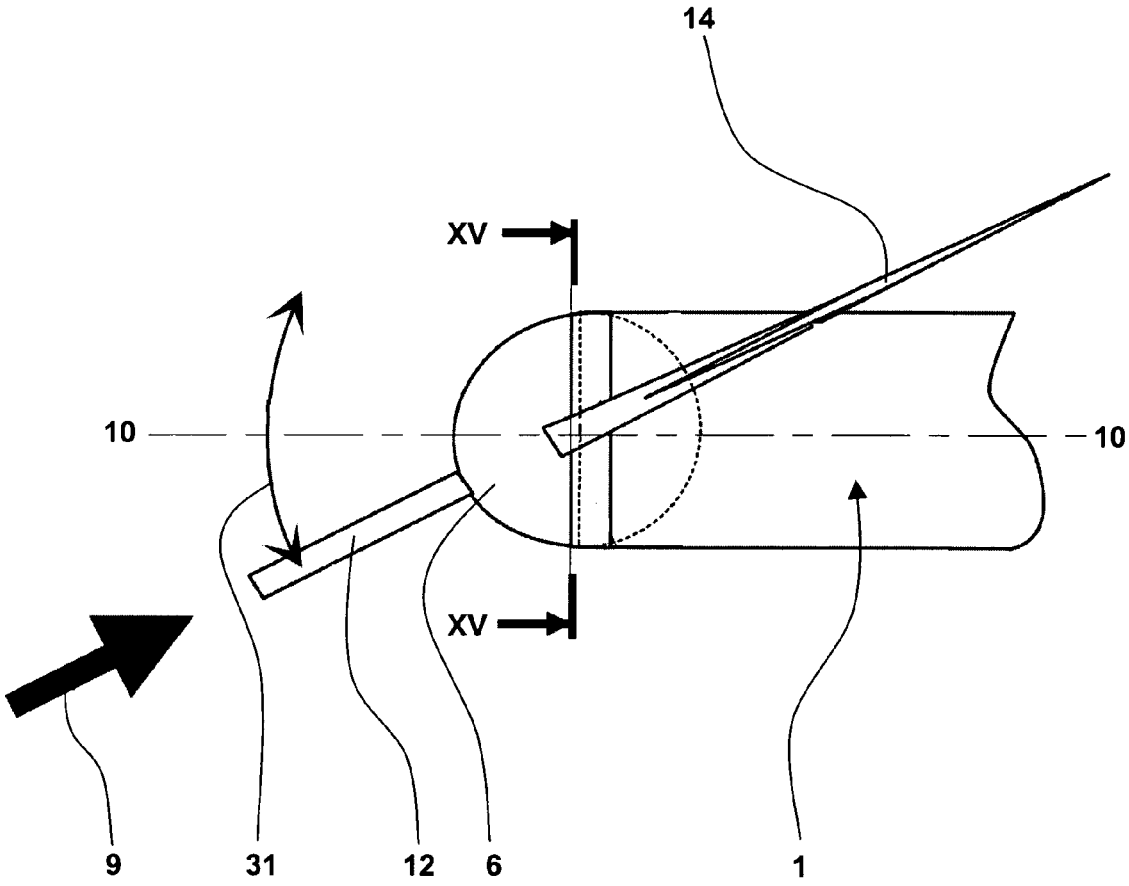
FIG. 13 shows a flying object according to the invention in a lateral view wherein pivoting of the aerospike with respect to an axis fixed at the flying object is caused by passive justifying elements.
Figure 14:
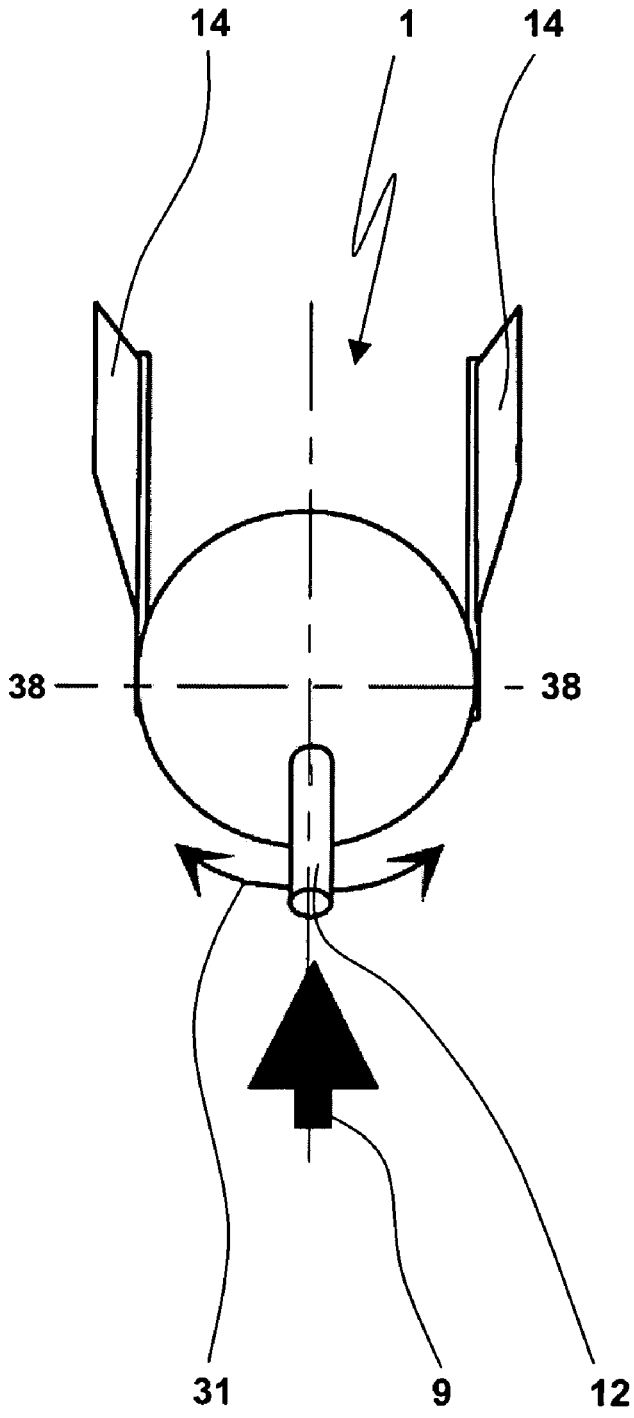
FIG. 14 shows the flying object according to FIG. 13 in a front view.
Figure 15:
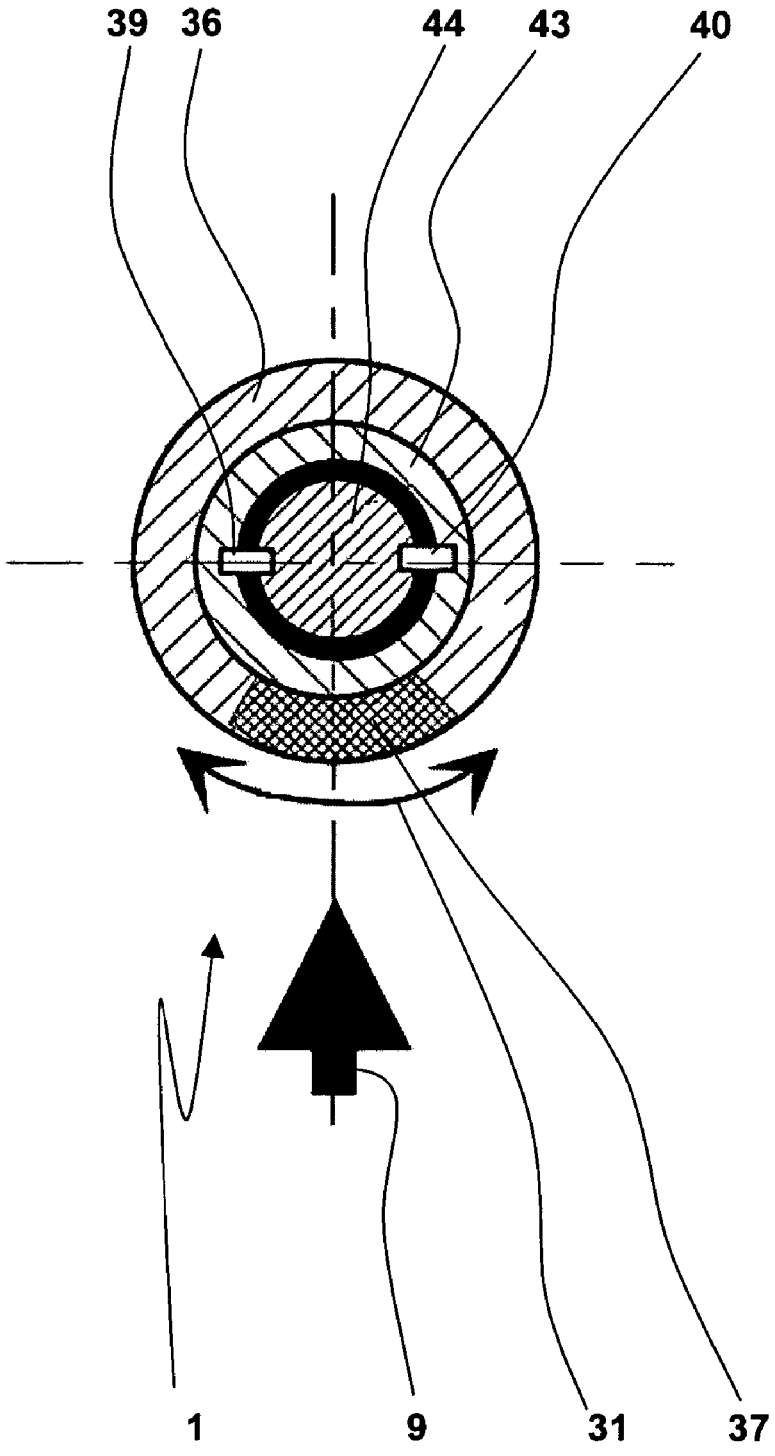
FIG. 15 shows the flying object according to FIGS. 13 and 14 in a cross-sectional view XV-XV.

FIGS. 13 to 15 show another embodiment of the invention for providing a pivoting movement of the aerospike 12 caused by justifying elements 14. According to such embodiment, aerospike 12 and justifying elements 14 are rigidly fixed at an outer sleeve 36. The outer sleeve 36 has a sliding pivoting degree of freedom with respect to the longitudinal axis 10-10. The sleeve is supported by an outer cylindrical girthed area of a hollow cylindrical intermediate body 43. As also described for FIGS. 10 to 12, the sleeve 36 (and the affixed additional components as aerospike 12 and justifying elements 14) might have a center of gravity being located eccentrically with respect to longitudinal axis 10-10. The intermediate body 13 is linked by means of bearing pins 39, 40 aligned with the transverse axis 38-38 for providing a swiveling movement. The bearing pins 39, 40 are supported by an inner body 44 of the flying object 1. The bearing pins 39, 40 are fixed at the inner body 44. A rotational degree of freedom is provided between bearing eyes of the intermediate body 43 and bearing pins 39, 40. According to an alternative embodiment the bearing pins 39, 40 might be fixed at the intermediate body 43 and pivoted with respect to bearing eyes of the inner body 44.

In case of a head for seeking a target with a dome being located at the front end region of the flying object usually a blunt shape of the nose is used which might be necessary for providing the different functions of the head for seeking a target. Such blunt shape of the nose leads to an increased aerodynamic resistance. Such design might lead to the formation of an increased shock wave for supersonic velocities. When entering the shock wave, the entropy of the floating medium increases wherein at the same time the resting pressure decreases. Such phenomenon causes the so called wave drag of the flying object which highly increases with the intensity of the shock wave and the flight velocity.

From [1]-[5] it is known that during linear flight the use of aerospikes might lead to a decrease of the resistance of up to 80%. The stiff connection of an aerospike with the nose and the flying object leads to suboptimal conditions for inclination angles differing from zero leading to an increased resistance [1, 5]. For that reason the preferred field of use for aerospikes is a ballistic flying object that is not highly maneuvered.

According to [1], the effects of inclination angles differing from zero for embodiments with the aerospike being fixed with respect to the longitudinal axis of the flying objects are as follows: for an inclination angle $\alpha=0°$ the aerospike leads to reductions of approximately 50%. For an inclination angle $\alpha=5°$ the positive effect reduces to 33%, whereas for an inclination angle of $\alpha=10°$ there are only savings of 10% and for an inclination angle of $\alpha=15°$ there are only savings of 5%. More or less the same holds for optimized variants of aerospikes that have been investigated for Mach numbers of 4.5 in [5]. It has been proven that for inclination angles larger than 15°-17° the known aerospikes lead to an increased resistance compared with a blunt reference body (see [5]).

The size, length or cross-section of the aerospike might depend on the type of mission, the type of aerospike used and on the expected velocity regions. The publications disclose rigid aerospikes for low supersonic velocities (Mach numbers between 1.8 and 3) wherein the investigated most effective aerospikes are blunt aerospikes with a relative thickness which in general is smaller than 0.2 D. The relative length is in the range of (1-2) D. Here D denotes the diameter of the front surface of the flying object.

According to [1] investigations have shown that under use of aerospikes the characteristic value $c_w$ of the resistance might be decreased for Mach number 1.8 from 0.6 to 0.3 which correlates to absolute savings of 0.3 or relative savings of 50%. Under an inclination angle of a flying object without an aerospike of 15° the $c_w$-value increases to 0.8. The addition of an aerospike which is fixed with respect to the longitudinal axis of the flying object the value $c_w$ decreases to 0.72 (10% saving). According to the invention, wherein the orientation of the aerospike is adapted to the flight direction and the inclination angle, the savings are expected to sum up to 0.3 resulting in a value $c_w$ of approximately 0.5. Accordingly, the saving would sum up to 25%. The aforementioned effects might increase for larger Mach numbers due to the fact that the wave drag increases exponentially with increasing Mach number. The aforementioned estimates for the savings are only tentative. The estimates base on any savings due to aerodynamic optimizations. Estimates basing on improvements for following a target in an effective way might lead to further savings.

Differing from the shown embodiments, an equilibrium position of the pivoting angle 13 might be achieved under use of spring elements or snapping or resting connections for an inclination angle equal zero.

Many variations and modifications may be made to the preferred embodiments of the invention without departing substantially from the spirit and principles of the invention. All such modifications and variations are intended to be included herein within the scope of the present invention, as defined by the following claims.

I claim:

1. Flying object for transonic or supersonic velocities comprising an aerospike configured as a rod-shaped spike extending in upstream up direction from a front face of said flying object and exposed to airflow;

wherein at least a distal end of the aerospike is exposed to the airflow;

wherein said aerospike is linked with the flying object such that it is possible to pivot said aerospike during a flight phase of the flying object with respect to an axis oriented transverse to a longitudinal axis of the flying object;

wherein said aerospike is mounted with at least one justifying element wherein said aerospike is fixed to a moveable surface;

wherein said aerospike, said moveable surface, and at least one justifying element are operative to pivot together as one unit; and wherein said at least one justifying element comprises a surface positioned directly within the airflow such that passive interaction of the surface with the airflow causes pivoting of said aerospike at transonic or supersonic velocities wherein said rod-like spike is fixed to a moveable surface; and wherein said rod-like spike and said moveable surface are operative to pivot together as one unit.

2. The flying object according to claim 1, wherein said at least one justifying element is built with one element selected from the group consisting of a lattice wing and a grid fin.

3. The flying object according to claim 1, wherein said front face is built with a dome designed and arranged for covering a device for seeking a target.

4. The flying object according to claim 1, wherein said aerospike comprises an enlargement at said distal end region of said spike.

5. The flying object according to claim 1, wherein said at least one justifying element extends outwardly from a girthed area of the flying object.

6. The flying object according to claim 1, wherein said moveable surface is positioned adjacent to said front face.

7. The flying object according to claim 6, wherein said moveable surface is positioned between said aerospike and said front face.

8. The flying object according to claim 6, wherein said moveable surface is an arcuate segment operative to move relative to said front face.

9. The flying object according to claim 1, wherein said front face comprises said moveable surface.

* * * * *